US010316802B2

(12) United States Patent
Shirley

(10) Patent No.: US 10,316,802 B2
(45) Date of Patent: Jun. 11, 2019

(54) EXHAUST GAS RECIRCULATION DEVICE FOR VEHICLE

(71) Applicants: Hyundai Motor Company, Seoul (KR); Kia Motors Corporation, Seoul (KR)

(72) Inventor: Mark Shirley, Albion, MI (US)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/471,125

(22) Filed: Mar. 28, 2017

(65) Prior Publication Data

US 2018/0283324 A1 Oct. 4, 2018

(51) Int. Cl.
*F02M 26/12* (2016.01)
*F02M 26/14* (2016.01)
*F02M 26/17* (2016.01)

(52) U.S. Cl.
CPC ..... *F02M 26/12* (2016.02); *F02M 26/14* (2016.02); *F02M 26/17* (2016.02)

(58) Field of Classification Search
CPC ..... F02M 26/12; F02M 26/17; F02M 26/14
See application file for complete search history.

(56) References Cited

U.S. PATENT DOCUMENTS 8,561,599 B2 10/2013 Gingrich et al.
2012/0114469 A1 5/2012 Glitz et al.
2013/0206116 A1 8/2013 Legrom et al.
2014/0331669 A1* 11/2014 Jones ..... F02M 25/0722 60/605.2

* cited by examiner

*Primary Examiner* — Jacob M Amick
*Assistant Examiner* — Charles Brauch
(74) *Attorney, Agent, or Firm* — Brinks Gilson & Lione

(57) ABSTRACT

An exhaust gas recirculation valve device for a vehicle includes: a mixer tube extending between an inlet end and an outlet end, a first plate at the inlet end, and a second plate at the outlet end. The mixer tube having a plurality of divider walls extending radially between the longitudinal axis and the outer wall longitudinally from the inlet to the outlet. The divider walls defining a plurality of mixing chambers therebetween for receiving and storing exhaust gas from a dedicated engine cylinder. The first plate rotatably disposed at the inlet end of the tube, and the second plate rotatably disposed at the second end of the mixer tube to selectively block off at least one chamber at the inlet and outlet ends, respectively. The mixer configured to capture and distribute recirculated exhaust gas corresponding to an operating speed of the engine.

15 Claims, 4 Drawing Sheets

EXHAUST GAS RECIRCULATION DEVICE FOR VEHICLE

FIELD

The present disclosure relates to an exhaust gas recirculation (EGR) device for a vehicle and a method of recirculating exhaust gas.

BACKGROUND

The statements in this section merely provide background information related to the present disclosure and may not constitute prior art.

In general, large amounts of harmful substances to humans such as carbon monoxide and nitrogen oxides are contained in exhaust gases emitted from a vehicle engine. Strict regulations are being enforced on nitrogen oxides because the nitrogen oxides are particularly harmful in that they contribute to acid rain, global warming, and respiratory problems.

The nitrogen oxides have the property that, as the combustion temperature of fuel in the engine increases, so does the amount of nitrogen oxides.

Many attempts have been made to reduce nitrogen oxide emissions, among which an exhaust gas recirculation (EGR) system is usually applied to vehicles.

The EGR system recirculates part of the exhaust gas emitted from the engine after fuel combustion to an intake system of the engine to direct it back to a combustion chamber of the engine. As a consequence, an air-fuel mixture decreases in density without a change in the air-fuel ratio of the air-fuel mixture, thus lowering the combustion temperature.

That is, the EGR system supplies a portion of exhaust gas to an intake manifold of the engine to direct it to the combustion chamber when there is a need to reduce nitrogen oxide emissions depending on the operating state of the engine. By doing so, exhaust gases help to decrease the density of the mixture to a lower level and therefore decrease the flame propagation velocity during fuel combustion. This suppresses an increase in combustion temperature and slows the fuel combustion, thereby suppressing the generation of nitrogen oxides.

Some EGR systems use a dedicated EGR cylinder type engine, where one engine cylinder supplies a high volume of exhaust gas to the EGR system at rates approaching 25% of exhaust gas being recirculated to the intake system of the engine. Such dedicated EGR systems can provide a slight supercharging effect. To attempt to control exhaust gas delivery to engine inlets equally and thereby increase engine stability, existing dedicated cylinder EGR systems attempt to restrict the exhaust gas recirculation flow and slow the passage of the EGR into the engine inlet stream. We have discovered that such existing dedicated cylinder EGR systems can be difficult to design and implement correctly, result in high pumping work and loss of fuel economy, and tend to be only effective at certain engine operating conditions due to varying gas flow rates.

SUMMARY

The present disclosure provides an exhaust gas recirculation (EGR) device for a vehicle and a method of recirculating exhaust gas from a dedicated cylinder of an engine. The EGR device and method use a mechanical device to capture, divide, and release EGR flow gas from a dedicated EGR cylinder in timed increments.

An Exhaust Gas Recirculation (EGR) mixer according to one form of the present disclosure includes a mixer tube, a first plate, and a second plate. The mixer tube has an outer wall extending between a first end and a second end. The outer wall of the mixer tube defines a central longitudinal axis about which the mixer tube rotates. The tube has a plurality of divider walls that extend radially between the longitudinal axis and the outer wall. The divider walls also extend longitudinally from the first end to the second end of the mixer tube. The divider walls define a plurality of mixing chambers therebetween. The first plate is rotatably disposed about the longitudinal axis at the first end of the mixer tube to selectively block off at least one chamber at the first end of the mixer tube. The first plate defines an opening therethrough sized to correspond to a first subset of the plurality of mixing chambers. The second plate is rotatably disposed about the longitudinal axis at the second end of the mixer tube to selectively block off at least one chamber at the second end of the mixer tube. The second plate defines an opening therethrough sized to correspond to a second subset of the plurality of mixing chambers.

According to one form, the first subset of the plurality of mixing chambers is approximately 25% of the plurality of mixing chambers, such that the first plate selectively blocks off approximately 75% of the chambers at the first end of the mixer tube.

In another form, the second subset of the plurality of mixing chambers is approximately 8% of the plurality of chambers, such that the second plate selectively blocks off approximately 92% of the chambers at the second end of the mixer tube.

According to one form of the present disclosure, rotation of the EGR mixer is driven by a timing belt that extends from an engine crankshaft. The mixer tube of the EGR mixer may be driven to rotate at a speed that is two times the operating speed of the engine crankshaft. The first plate of the EGR mixer may be driven to rotate at a speed that is half of the operating speed of the engine crankshaft. The second plate of the EGR mixer may be driven to rotate at a speed that is one and a half times the operating speed of the engine crankshaft.

In another form, the EGR mixer may also include an exhaust delivery tube configured to deliver exhaust gas from a dedicated cylinder of an engine to the first subset of the plurality of mixing chambers through the opening in the first plate. Exhaust gas may be delivered to the first subset of the plurality of mixing chambers only during an exhaust stroke of the dedicated cylinder of the engine. Additionally, the EGR mixer may also include an exhaust supply tube configured to supply exhaust from the second subset of the plurality of mixing chambers through the opening in the second plate to an intake manifold of an engine.

The present disclosure also provides an Exhaust Gas Recirculation (EGR) system for recirculating exhaust gas from a dedicated EGR cylinder of an engine to an intake manifold of the engine. The EGR system according to one form may include an EGR mixer having a mixer tube that has an outer wall extending between an inlet end and an outlet end and that defines a central longitudinal axis about which the mixer tube rotates. The tube has a plurality of divider walls that extend radially between the longitudinal axis and the outer wall and that extend longitudinally from the inlet end to the outlet end of the mixer tube. The plurality of divider walls define a plurality of mixing chambers therebetween. The EGR mixer also has a first plate rotatably disposed about the longitudinal axis at the inlet end of the mixer tube to selectively block off at least one chamber at the inlet end of the mixer tube. The first plate defines an opening therethrough sized to correspond to a first subset of the plurality of mixing chambers. The EGR mixer also has a second plate rotatably disposed about the longitudinal axis at the outlet end of the mixer tube to selectively block off at least one chamber at the outlet end of the mixer tube. The second plate defines an opening therethrough sized to correspond to a second subset of the plurality of mixing chambers. The EGR system also includes an exhaust delivery tube configured to deliver exhaust gas from the dedicated EGR cylinder of the engine to the first subset of mixing chambers through the opening in the first plate and an exhaust supply tube configured to supply exhaust from the second subset of mixing chambers to the intake manifold of the engine through the opening in the second plate.

According to one for, the exhaust gas may be delivered to the first subset of mixing chambers through the opening in the first plate only during an exhaust stroke of the dedicated cylinder of the engine.

In one form, the first subset of mixing chambers may include more mixing chamber than the second subset of mixing chambers.

In yet another form, the EGR system may also include at least one timing belt extending between a crankshaft of the engine and the EGR mixer to drive rotation of the mixer tube, the first block off plate, and the second block off plate based on an operating speed of the crankshaft. The mixer tube may be driven to rotate about the longitudinal axis at a first speed, the first plate may be driven to rotate about the longitudinal axis at a second speed, and the second plate may be driven to rotate about the longitudinal axis at a third speed. The first speed, the second speed, and the third speed may be correlated to the operating speed of the crankshaft by a fixed ratio.

The present disclosure also provides a method of recirculating exhaust gas from a dedicated cylinder of an engine to an intake manifold of the engine. In one form, the method includes providing an Exhaust Gas Recirculation (EGR) device having a tube having a plurality of chambers each having an inlet and an outlet; selectively blocking a first portion of the inlets of the plurality of chambers to store exhaust gas in selected chambers; and selectively blocking a second portion of the outlets of the plurality of chambers to control the supply of exhaust gas recirculated to the intake manifold of the engine.

In one form, the first portion of blocked inlets of the plurality of chambers is less than the second portion of blocked outlets of the plurality of chambers.

In another form, the first selectively blocking step may include rotating a first block off plate having a first opening at a first speed. Additionally, the second selectively blocking step may include rotating a second block off plate having a second opening at a second speed that is three times the first speed. The method may also include rotating the tube at a third speed that is four times the first speed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
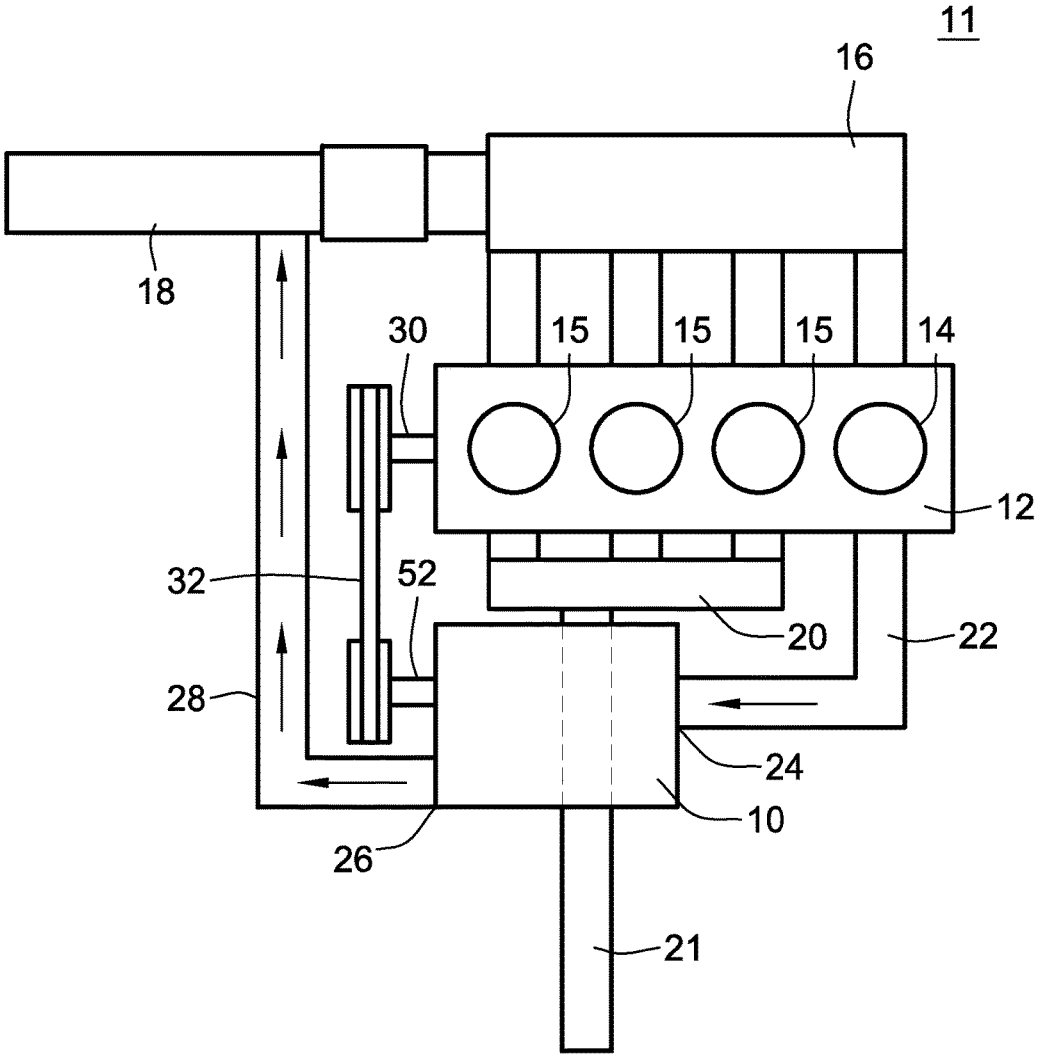
FIG. 1 is a schematic drawing of an engine having a dedicated cylinder exhaust gas recirculation system for a vehicle according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 is a schematic drawing of an engine having a dedicated cylinder exhaust gas recirculation system 11 for a vehicle according to one form of the present disclosure. As shown in FIG. 1, a dedicated cylinder exhaust gas recirculation system 11 for a vehicle (not shown) includes an engine 12 having a plurality of cylinders 15, 14. At least one of the engine cylinders is configured to be a dedicated exhaust gas recirculation cylinder 14. Air is supplied to the cylinders 15, 14 by an intake manifold 16, which generally receives air from an air inlet 18. Combustion gasses are exhausted from the non-EGR cylinders 15 through a typical exhaust manifold 20 and exhaust 21.

Combustion gas produced by the dedicated cylinder 14, i.e. EGR gas, is provided to the EGR device 10 through an exhaust delivery tube 22. EGR gas enters the EGR device 10 through an EGR inlet 24 at a first/inlet end 41 of the EGR device 10. EGR gas exits the EGR device 10 through an EGR outlet 26 at a second/outlet end 43 of the EGR device 10. Upon exiting the EGR device 10, the EGR gas is supplied to the air inlet 18 and intake manifold 16 by an exhaust supply tube 28. Thus, the dedicated EGR cylinder 14 of the engine 12 supplies a high volume of exhaust gas to the EGR system 11 at rates approaching approximately 25% of exhaust gas being recirculated to the intake 16 of the engine 12. The EGR device 10 captures and equally distributes exhaust gas from less than all cylinders in the engine, and thus the exhaust gas recirculation flow is stretched temporally to deliver the EGR gas steadily or equally over time.

As will be described in further detail below, a crankshaft 30 of the engine 12 drives the operation of the EGR device 10 by a timing belt 32 which extends between the crankshaft 30 and the EGR mixer 10.

Figure 2:
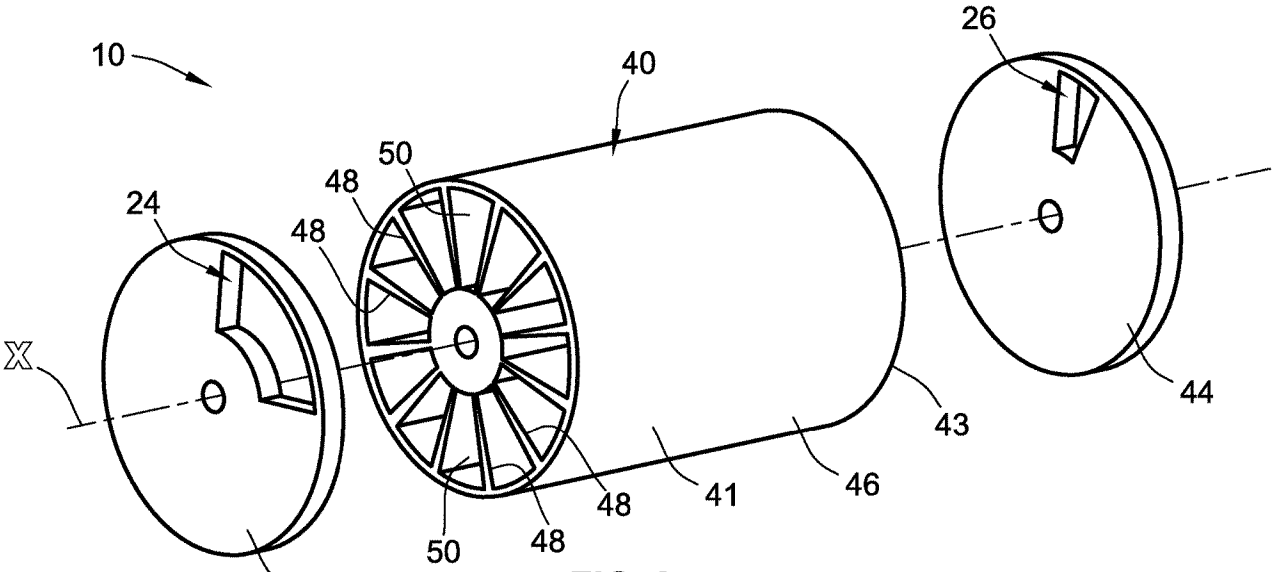
FIG. 2 is an exploded isometric view of an exhaust gas recirculation mixer device for a vehicle according to one form of the present disclosure.

Referring to FIG. 2, an Exhaust Gas Recirculation (EGR) mixer 10 according to one form of the present disclosure includes a mixer tube 40, a first plate 42, and a second plate 44. The mixer tube 40 has an outer wall 46 extending between a first end 41 and a second end 43. The outer wall 46 of the mixer tube 40 defines a central longitudinal axis X about which the mixer tube 40 rotates. The first plate 42 serves as an inlet plate or disc that allows entrance of exhaust gas only during the exhaust stroke of the dedicated cylinder (or cylinders), and is closed off thereafter. The second plate 44 serves as an outlet plate or disc that directs the captured exhaust gas to the intake manifold in a timed manner that temporally stretched to provide improved distribution.

The tube 40 has a plurality of divider walls 48 that extend radially between the longitudinal axis X and the outer wall 46. The divider walls 46 may start at the center of the tube 40, or may be offset from the center of the tube 40, as shown. The divider walls 48 also extend longitudinally, or parallel to the longitudinal axis X, along the length of the tube 40 from the first end 41 to the second end 43 of the mixer tube 40.

The divider walls 48 define a plurality of mixing chambers 50 therebetween. The mixing chambers 50 may have a generally triangular shape, as shown, or any other suitable shape. The chambers 50 may be equally sized. As shown in FIG. 2, the mixer tube 40 has twelve divider walls 48 which define twelve chambers 50; however, the size and number of chambers 50 may be increased or decreased based on design requirements.

Figure 3B:
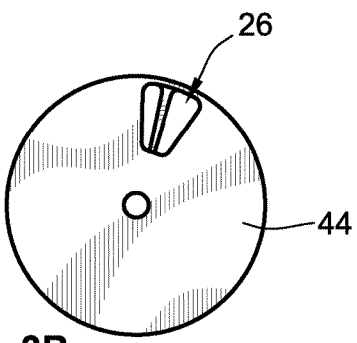
FIG. 3B is a rear view of exhaust gas recirculation mixer device of FIG. 2.
Figure 3A:
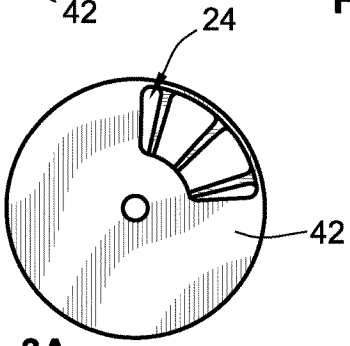
FIG. 3A is a front view of exhaust gas recirculation mixer device of FIG. 2.

As shown in FIGS. 2 and 3A, the first plate 42 is rotatably disposed about the longitudinal axis X at the first end 41 of the mixer tube 40 to selectively block off at least one chamber 50 at the first end 41 of the mixer tube 40. The first plate 42 defines an opening 24 therethrough sized to correspond to a first subset of the plurality of mixing chambers 50. According to one form, the first subset of the plurality of mixing chambers is approximately 25% of the plurality of mixing chambers 50. For example, when the mixer tube 40 includes twelve chambers 50 as shown, the first subset of mixing chambers 50 may be approximately three chambers 50. In this case, the opening 24 through the first plate 42 is sized to correspond to three chambers 50. The rest of the first plate 42 selectively blocks off approximately 75% of the chambers 50, or the remaining nine chambers 50, at the first end 41 of the mixer tube 40. Stated another way, the opening 24 in the first plate 42 spans about 90 degrees radially, or relative to the crank angle degree (CAD) spans from 540 CAD to 720 CAD to correspond to the exhaust stroke of the selected cylinder used for exhaust recirculation. During 0 to 540 CAD, no exhaust is captured by the device 10.

As shown in FIGS. 2 and 3B, the second plate 44 is rotatably disposed about the longitudinal axis X at the second end 43 of the mixer tube 40 to selectively block off at least one chamber 50 at the second end 43 of the mixer tube 40. The second plate 44 defines an opening 26 therethrough sized to correspond to a second subset of the plurality of mixing chambers 50. In one form, the second subset of the plurality of mixing chambers 50 is approximately 8% of the plurality of chambers 50. For example, when the mixer tube 40 includes twelve chambers 50 as shown, the second subset of mixing chambers 50 may be approximately one chamber 50. In this case, the opening 26 through the second plate 44 is sized to correspond to one chamber 50. The rest of the second plate 44 selectively blocks off approximately 92% of the chambers 50, or the remaining eleven chambers 50, at the second end 43 of the mixer tube 40. Stated another way, the opening 26 in the second plate 44 spans about 20 degrees radially.

The first and second plates 42, 44 may be circular as shown or any other suitable shape. Generally, the first subset of mixing chambers 50 includes more mixing chambers 50 than the second subset of mixing chambers 50.

Referring again to FIG. 1, rotation of the EGR mixer 10 may be driven by a timing belt 32 that extends from an engine crankshaft 30 to an input shaft 52 of the mixer. The rotation speed of each of the mixer tube 40, the first plate 42, and the second plate 44 are based on an operating speed of the crankshaft 30. The mixer tube 40 of the EGR mixer 10 may be driven to rotate at a first speed, which in one example is about two times the operating speed of the engine crankshaft 30. The first plate 42 (i.e inlet plate or disk) of the EGR mixer 10 may be driven to rotate at a second speed, which in one example is about half of the operating speed of the engine crankshaft 30. The second plate 44 (i.e. outlet plate or disk) of the EGR mixer 10 may be driven to rotate at a third speed, which in one example is one and a half times the operating speed of the engine crankshaft 30. In this way, the first speed, the second speed, and the third speed are correlated to the operating speed of the crankshaft 30 by a fixed ratio. Rotating the various parts 40, 42, 44 of the EGR mixer 10 at different speeds results in the first plate 42 and second plate 44 selectively blocking off and opening different chambers 50 as the plates 42 and 44 rotate.

Stated another way, the mixer tube 40 rotates one full revolution for each full dedicated cylinder exhaust stroke, thereby capturing the full volume of EGR gas in relatively equal volumes. The inlet or first plate 42 rotates to correspond to the exhaust stroke of the dedicated cylinder, while the outlet or second plate 44 rotates faster than the first plate 42, but slightly slower than the mixer tube 40, to release the exhaust gas in a given chamber of the tube 40 at equally spaced intervals. In this way, the mixer 10 is timed to the engine's exhaust port open timing to provide dedicated, controlled exhaust.

Figure 5:
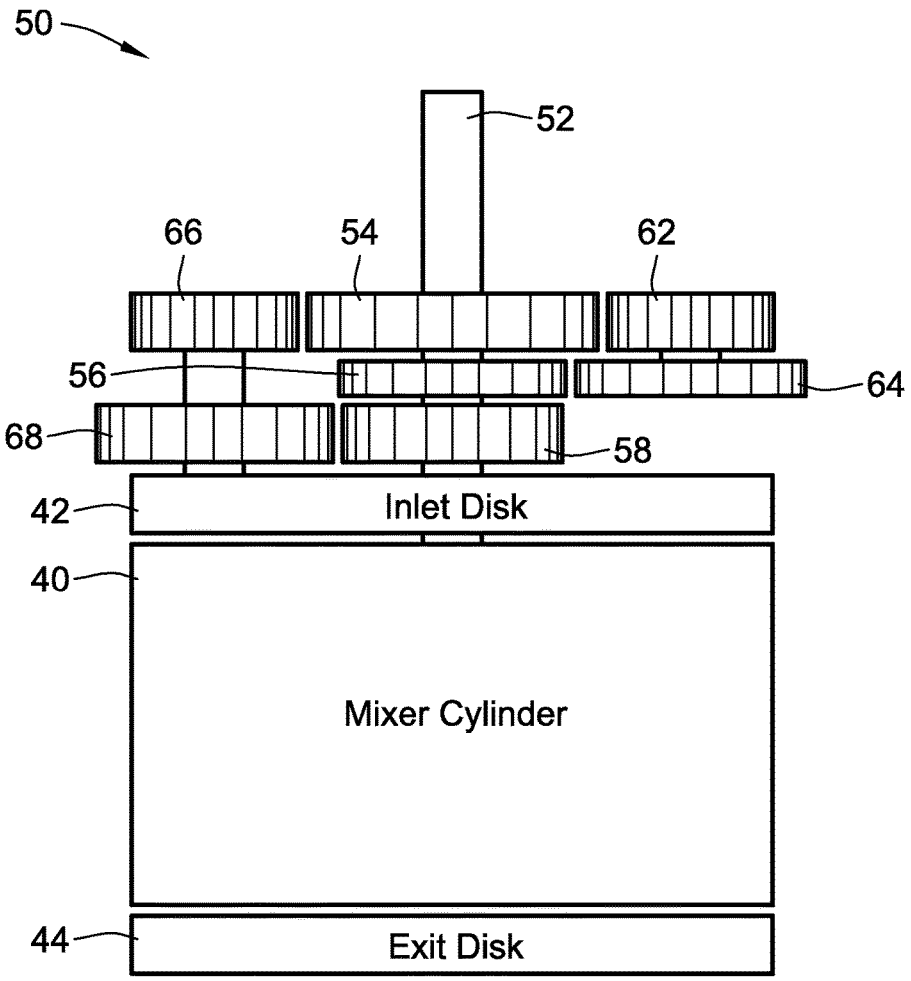
FIG. 5 is a schematic of a gearing system interconnecting the engine and the exhaust gas recirculation mixer of FIGS. 1-3.

The relative rotation of the first plate 42, mixer tube 40, and second plate 44 at different speeds (e.g. at ½ times, 2 times, and 1.5 times of crankshaft speed, respectively) may be accomplished by using a gearing system such as a form of planetary gear system, or using belts and pulleys or the like, as well as co-axial shafts that surround the driven input shaft and connect to the three elements. One example of a geared system is shown in FIG. 5. The input shaft 52 is driven at one-half engine speed, e.g. through appropriately sized pulleys and belt 32 (FIG. 1), although a geared connection could also be used to link the input shaft 52 to a shaft from the engine. The input shaft 52 is directly connected to first gear 54 for continuous rotation therewith, and is also directly connected to the first (inlet) plate 42 for continuous rotation therewith at about ½ crankshaft.

A second gear 54 and a third gear 56 float on the input shaft 52 for rotation relative thereto. The second gear 54 drives rotation of the mixer cylinder 40, e.g. through a tubular sleeve fit over the input shaft, while the third gear 56 drives rotation of the second plate 44, e.g. also through a tubular sleeve fit over the input shaft and the other tubular sleeve of the second gear 54. The first gear 54 is operatively connected to the second gear 56 through gears 62 and 64 which are drivingly connected via a common shaft. Through sizing of the gears, the second gear 56, and hence the mixer cylinder 40, may be driven at a higher speed such as twice (2×) the engine crankshaft, or four times (4×) the speed of the first inlet plate 42.

The first gear 54 is also operatively connected to the third gear 58 through gears 66 and 68 which are connected via a comment shaft. Through sizing of the gears, the third gear 58, and hence the second outlet plate 44, may be driven at a higher speed such as three times (3×) the speed of the first inlet plate 42. In one representative example, for every two (2) revolutions of the engine crankshaft, the rotating elements of the mixer may have the following rotation: one (1) rotation of the first plate 42, four (4) rotations of the mixer cylinder 40, and three (3) rotations of the second plate 44. For example, if the crankshaft is spinning at about 1000 RPM, the first plate 42 may spin at about 500 RPM, the mixer cylinder may spin at about 2000 RPM, and the second plate 44 may spin at about 1500 RPM. Different ratios of these rotating elements may be selected by the skilled artisan based on the size of the engine, the number of cylinders being recirculated, the size and number of chambers in the mixer cylinder 40, and the size of the inlet and outlet openings in the first and second plates 42, 44.

EGR gas may be delivered to the EGR mixer 10 through an exhaust delivery tube 22 configured to deliver exhaust gas from a dedicated cylinder 14 of an engine 12 to the first subset of the plurality of mixing chambers 50 through the opening 24 in the first plate, i.e. the mixer 10 inlet. EGR gas is delivered to the first subset, i.e. the open chambers 50, of the plurality of mixing chambers 50 during an exhaust stroke of the dedicated cylinder 14 of the engine 12. EGR gas is recirculated to the intake 18 and the intake manifold 16 from the EGR mixer 10 may by an exhaust supply tube 28 configured to supply exhaust from the second subset of the plurality of mixing chambers 50, i.e. the open chambers 50 at the second end 43, through the opening 26 in the second plate 44.

Figure 4:
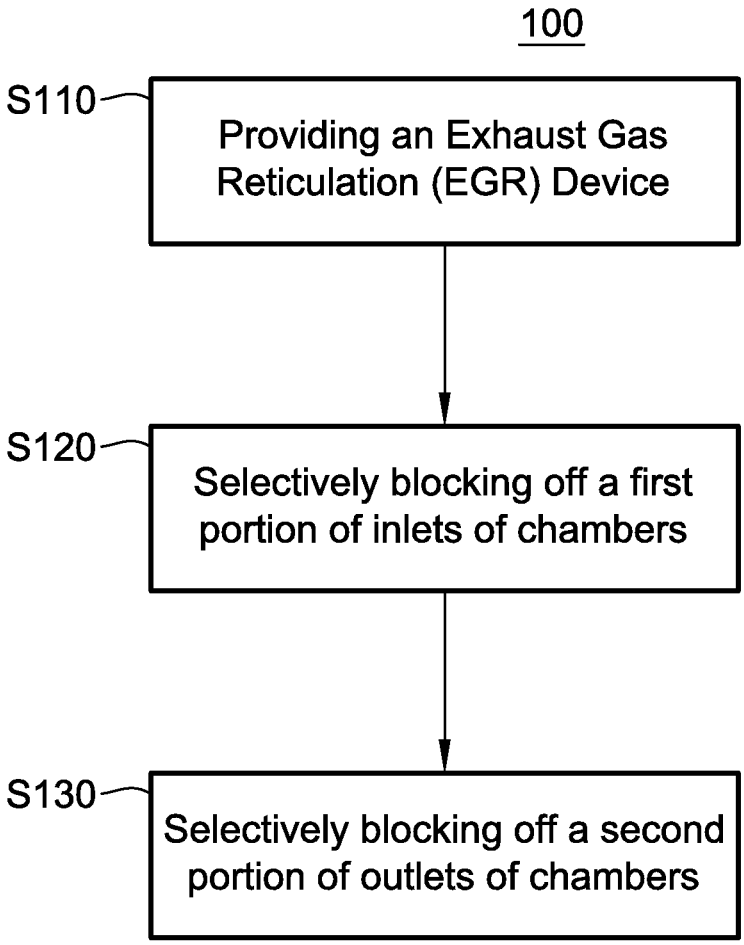
FIG. 4 is a flowchart showing a method of recirculating exhaust gas from a dedicated cylinder of an engine to an intake system of the engine according to one form of the present disclosure.

Referring now to FIG. 4, a method 100 of recirculating exhaust gas from a dedicated cylinder of an engine to an intake manifold of the engine is shown. The method includes providing an Exhaust Gas Recirculation (EGR) device 10 having a tube 40 having a plurality of chambers 50 each having an inlet 41 and an outlet 43 at step S110. The method continues by selectively blocking a first portion of the inlets 41 of the plurality of chambers 50 to store exhaust gas in selected (open) chambers 50 at step S120, and selectively blocking a second portion of the outlets 43 of the plurality of chambers 50 to control the supply of exhaust gas recirculated to the intake manifold 16 of the engine 12 at step S130. The first portion of blocked inlets 41 of the plurality of chambers 50 may be less than the second portion of blocked outlets 43 of the plurality of chambers 50.

The first selectively blocking step S120 may include rotating a first block off plate 42 having a first opening 24 at a first speed. Additionally, the second selectively blocking step S130 may include rotating a second block off plate 44 having a second opening 26 at a second speed that is three times the first speed. The method may also include rotating the tube 40 at a third speed that is four times the first speed.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

What is claimed is:

1. An Exhaust Gas Recirculation (EGR) mixer comprising:

a mixer tube having an outer wall extending between a first end and a second end and defining a central longitudinal axis about which the mixer tube rotates, the tube having a plurality of divider walls extending radially between the longitudinal axis and the outer wall and extending longitudinally from the first end to the second end of the mixer tube, the plurality of divider walls defining a plurality of mixing chambers therebetween and blocking communication between the mixing chambers such that each mixing chamber extends longitudinally from the first end to the second end;

a first plate rotatably disposed about the longitudinal axis relative to the mixer tube at the first end of the mixer tube to selectively block off at least one chamber at the first end of the mixer tube, the first plate defining an opening therethrough sized to correspond to a first subset of the plurality of mixing chambers; and a second plate rotatably disposed about the longitudinal axis relative to the mixer tube at the second end of the mixer tube to selectively block off at least one chamber at the second end of the mixer tube, the second plate defining an opening therethrough sized to correspond to a second subset of the plurality of mixing chambers.

2. The EGR mixer of claim 1 wherein the first subset of the plurality of mixing chambers is approximately 25% of the plurality of mixing chambers, such that the first plate selectively blocks off approximately 75% of the chambers at the first end of the mixer tube.

3. The EGR mixer of claim 1 wherein the second subset of the plurality of mixing chambers is approximately 8% of the plurality of chambers, such that the second plate selectively blocks off approximately 92% of the chambers at the second end of the mixer tube.

4. The EGR mixer of claim 1 wherein rotation of the EGR mixer is driven by a timing belt extending from an engine crankshaft, the engine crankshaft having an operating speed.

5. The EGR mixer of claim 4 wherein the mixer tube of the EGR mixer rotates at a speed that is two times the operating speed of the engine crankshaft.

6. The EGR mixer of claim 4 wherein the first plate of the EGR mixer rotates at a speed that is half of the operating speed of the engine crankshaft.

7. The EGR mixer of claim 4 wherein the second plate of the EGR mixer rotates at a speed that is one and a half times the operating speed of the engine crankshaft.

8. The EGR mixer of claim 1 further comprising an exhaust delivery tube configured to deliver exhaust gas from a dedicated cylinder of an engine to the first subset of the plurality of mixing chambers through the opening in the first plate.

9. The EGR mixer of claim 8 wherein exhaust gas is delivered to the first subset of the plurality of mixing chambers only during an exhaust stroke of the dedicated cylinder of the engine.

10. The EGR mixer of claim 1 further comprising an exhaust supply tube configured to supply exhaust from the second subset of the plurality of mixing chambers through the opening in the second plate to an intake manifold of an engine.

11. An Exhaust Gas Recirculation (EGR) system for recirculating exhaust gas from a dedicated EGR cylinder of an engine to an intake manifold of the engine, the EGR system comprising:

an EGR mixer comprising a mixer tube having an outer wall extending between an inlet end and an outlet end and defining a central longitudinal axis about which the mixer tube rotates, the tube having a plurality of divider walls extending radially between the longitudinal axis and the outer wall and extending longitudinally from the inlet end to the outlet end of the mixer tube, the plurality of divider walls defining a plurality of mixing chambers therebetween and blocking communication between the mixing chambers such that each mixing chamber extends longitudinally from the first end to the second end; a first plate rotatably disposed about the longitudinal axis relative to the mixer tube at the inlet end of the mixer tube to selectively block off at least one chamber at the inlet end of the mixer tube, the first plate defining an opening therethrough sized to correspond to a first subset of the plurality of mixing chambers; and a second plate rotatably disposed about the longitudinal axis relative to the mixer tube at the outlet end of the mixer tube to selectively block off at least one chamber at the outlet end of the mixer tube, the second plate defining an opening therethrough sized to correspond to a second subset of the plurality of mixing chambers;

an exhaust delivery tube configured to deliver exhaust gas from the dedicated EGR cylinder of the engine to the first subset of mixing chambers through the opening in the first plate; and an exhaust supply tube configured to supply exhaust from the second subset of mixing chambers to the intake manifold of the engine through the opening in the second plate.

12. The EGR system of claim 11 wherein exhaust gas is delivered to the first subset of mixing chambers through the opening in the first plate only during an exhaust stroke of the dedicated cylinder of the engine.

13. The EGR system of claim 11 wherein the first subset of mixing chambers includes more mixing chamber than the second subset of mixing chambers.

14. The EGR system of claim 11 further comprising at least one timing belt extending between a crankshaft of the engine and the EGR mixer to drive rotation of the mixer tube, the first block off plate, and the second block off plate based on an operating speed of the crankshaft.

15. The EGR system of claim 14 wherein the mixer tube rotates about the longitudinal axis at a first speed, the first plate rotates about the longitudinal axis at a second speed, and the second plate rotates about the longitudinal axis at a third speed, and wherein the first speed, the second speed, and the third speed are correlated to the operating speed of the crankshaft by a fixed ratio.

* * * * *